United States Patent [19]

Irie et al.

[11] 3,932,237

[45] Jan. 13, 1976

[54] METHOD FOR FORMING AN INSULATING GLASS FILM ON SURFACES OF AN ORIENTED SILICON STEEL SHEET

[75] Inventors: Toshio Irie, Kobe; Yasuo Yokoyama; Yoshihiko Kameishi, both of Ashiya; Katsuo Yamaguchi, Takarazuka; Kazuo Hamachi, Nishinomiya, all of Japan

[73] Assignee: Kawasaki Steel Corporation, Kobe, Japan

[22] Filed: Sept. 19, 1974

[21] Appl. No.: 507,277

[30] Foreign Application Priority Data

Oct. 30, 1973 Japan ..... 48-121174

[52] U.S. Cl. ..... 148/113; 148/31.5; 427/126; 148/112

[51] Int. Cl.[2] ..... H01F 1/04

[58] Field of Search ..... 148/113, 112, 111, 110, 148/31.55, 31.5; 427/126, 127, 132

[56] References Cited

UNITED STATES PATENTS

| | | | |
|---|---|---|---|
| 3,389,006 | 6/1968 | Kohler | 148/113 |
| 3,644,185 | 2/1972 | Benford et al. | 148/112 |
| 3,834,952 | 9/1974 | Matsushita et al. | 148/112 |

*Primary Examiner*—Walter R. Satterfield

[57] ABSTRACT

A highly adhesive and uniform insulating glass film can be formed on surfaces of an oriented silicon steel sheet by pickling a finally cold rolled silicon steel strip just before a decarburizing annealing, and successively subjecting the pickled steel strip to the decarburizing annealing, an application of an annealing separator and a final annealing at a high temperature.

4 Claims, 1 Drawing Figure

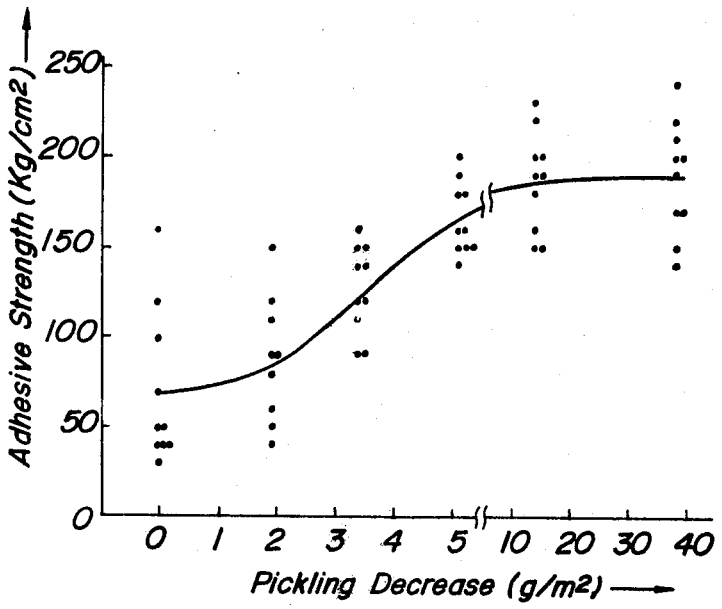
Adhesive Strength (Kg/cm2)
250
200
150
100
50
0
0
1
2
3
4
5
10
20
30
40
Pickling Decrease (g/m2)

METHOD FOR FORMING AN INSULATING GLASS FILM ON SURFACES OF AN ORIENTED SILICON STEEL SHEET

The present invention relates to a method for forming a highly adhesive uniform magnesia-silica electric insulating glass film on surfaces of an oriented steel sheet, wherein a cold rolled silicon steel strip having a desired final gauge is pickled just before a decarburizing annealing, and the pickled steel strip is successively subjected to the decarburizing annealing, applied with an annealing separator and subjected to a final annealing at a high temperature.

When oriented silicon steel sheets are used as a laminated core of a transformer, an insulating glass film is generally formed on the surfaces of the silicon steel sheets so that layers of the core are electrically insulated. Further, the glass film must satisfy many requirements, such as firm adhesion to the silicon steel base, uniformity of appearance, heat resistance, smoothness, etc. in addition to the electric insulating property.

In the conventional method for forming electric insulating glass films, a cold rolled silicon steel strip having a desired final gauge is continuously annealed at a temperature of 700° to 900°C for several minutes under a $H_2$—$H_2O$ containing atmosphere to effect simultaneously decarburization and the formation of an oxide film containing silica ($SiO_2$) on the steel strip surfaces by the oxidation of silicon contained in the steel, and then the above annealed steel strip is applied with an annealing separator containing magnesia (MgO) as a main component, wound up in the form of a coil and then subjected to a final annealing at a high temperature, whereby the above described $SiO_2$ and MgO are reacted to form a glass-like insulating coating (in this specification, such coating is Referered to as "glass film") consisting mainly of forsterite ($2MgO.SiO_2$).

However, the glass film produced in a commercial scale by this method is often poorly adhered to the steel base, and when a steel sheet having this glass film is subjected to a slitting or shearing working, glass film near the cut portion is often damaged. Furthermore, steel sheet surfaces having local areas devoid of glass film or having long, narrow white and grey uneven patterns are often formed, and thus, it has been difficult to consistently obtain uniform stable glass film. In order to solve these drawbacks, a large number of proposals have been made with respect to the grain size and purity of magnesia and to the additives. However, in any of the proposed methods, the above described drawbacks, particularly the adhesion of the glass film, have not yet been improved satisfactorily for all the uses of the oriented silicon steel sheet.

The oriented silicon steel sheet is mainly used as an iron core a transformer, and the iron core is generally classified into two types, a laminated core, and a wound core. The laminated core is produced by slitting or shearing a steel strip and laminating the slitted or sheared steel strips. In the laminated core, when the adhesion of a glass film to the steel base is not so weak as to be damaged in the slitting or shearing, the steel strip can be practically used. The wound core is produced in the following manner. Except for the ring core, a silicon steel strip is wound around a rectangular mold until a desired dimension is obtained, and then a stress relief annealing is effected. In this case, when the steel strip is wound around the mold, since the steel strip is bent to follow the rectangular configuration at the corner of the mold, the glass film flakes or drops off from the steel base at the bent portion, and as a result, the insulation resistance between the layers often lowered considerably. Furthermore, in the wound core, where a resin is impregnated between the layers and cured to fix the iron core, and finally the iron core is divided into two parts by means of a band saw in order to set coils for primary and secondary electric currents, a serious problem occurs because glass film near the cutting portion flakes and drops off from the steel base due to the continuous impact of the band saw and spaces (cracks) are often formed between the layers. When this occurs, the desired electric characteristic of the transformer cannot be developed fully and further the beat of the transformer is increased. That is, a very high adhesion of the glass film is required in the wound core type transformer, and the conventional methods for forming glass films cannot fully satisfy such requirement.

The prior investigations for improving the uniformity and adhesion of glass film have been predominantly directed to the purity, composition, grain size and applied amount of annealing separator. On the contrary, the inventors have remarked and investigated widely the influence of the surface condition of a steel sheet at the stage after the final cold rolling step and before the continuous decarburizing annealing step upon the uniformity and adhesion of glass film, and as a result, the inventors have found that pickling the steel sheet before the decarburizing annealing is effective in forming uniform and stable glass film having a remarkably improved adhesion, which does not flake and drop off from the steel base even under the severe working condition in the production of the iron core. In the conventional techniques alkali or electrolytic degreasing, the latter being a stronger degreasing method, has been carried out before the decarburizing annealing in order to remove the rolling oil used in the final cold rolling, but the pickling has never been carried out.

The reason why the inventors have utilized the pickling step is as follows. The glass film consisting mainly of forsterite is formed, as described above, by the reaction of silica in the oxide film formed during the decarburizing annealing with magnesia of the annealing separator during the final annealing at a high temperature. The inventors have found that it is an indispensable requirement, in order to obtain uniform glass film, that the oxide film formed during the decarburizing annealing always has a uniform composition and thickness over the entire steel sheet surface. They have also found that it is very important to control the surface condition of the steel sheet before the decarburizing annealing in addition to the strict regulation of the temperature, atmosphere and time of the decarburizing annealing in order to satisfy the requirement.

In the production of oriented silicon steel sheets, treating steps, such as hot rolling, removal of scale, first cold rolling, degreasing of rolling oil of the first cold rolling, intermediate annealing, second cold rolling, degreasing of rolling oil of the second cold rolling, etc. are generally carried out before decarburizing annealing. The surface of a steel sheet at the stage before the decarburizing annealing is apparently clean. But, for example, when a transparent adhesive tape is stuck to a thoroughly degreased surface of a finally cold rolled steel sheet and the tap is peeled off from the sheet, silvery black powders are adhered to the tape. The amount of the adhered powders is not always same, but the powders are adhered fairly firmly, and it is difficult to remove completely the adhered powders even by means of a revolving brush commonly used in the degreasing step of the rolling oil. Although it is impossible to measure accurately the amount of the adhered powders, when the amount is estimated from the difference of the weights of the adhesive tape before and after the test, it reaches about 0.5–2.0 g per 1 $m^2$ of the surface area of the steel sheet. Since the adhered powders consist mainly of Fe, Si and O, it is considered that thin scale formed on a steel sheet surface during the intermediate annealing prior to the final cold rolling is pulverized, pressed and adhered firmly on the steel sheet surface during the cold rolling. Further, it would seem that the removal of scale after the hot rolling is insufficient. It has been found that when such adhered scale is present, the degreasing agent for the rolling oil is not completely removed by washing with water.

As the reason for the contamination of the steel sheet surface before the continuous decarburizing annealing other than the above described adhered powders, mention may be made of the burning of rolling oil due to the temperature rising in the rolling and the rust formed in the case when the degreasing treatment was not effected immediately after the rolling.

The reason why a very highly uniform and stable insulating glass film is always obtained by carrying out the pickling according to the present invention prior to the continuous decarburizing annealing is presumably that the above described adhered powders and contamination on the steel sheet surface are completely removed, and the decarburizing reaction and the oxide film-forming reaction proceed uniformly over the entire steel sheet surface. Moreover, according to the present invention, the adhesion of glass film to the steel base is remarkably increased, and this is an unexpected and more important effect of the present invention. This effect cannot be explained from the phenomenon that the surface of the steel sheet before the decarburizing annealing is merely clean. For example, when scale formed on a steel sheet during the hot rolling is completely removed and an intermediate continuous annealing just before a final cold rolling is effected at a dew point of lower than −40°C under a dry hydrogen atmosphere so as not to form oxide film on the steel sheet surface, or when a pickling is effected with an aqueous acid solution containing several percent of fluoric acid, just after an intermediate continuous annealing, to remove completely scales formed on a steel sheet surface during the intermediate continuous annealing, the steel sheet surface after the final cold rolling and the degreasing of the rolling oil has a metallic luster similar to that of usual cold rolled mild steel sheet and is quite clean in the adhesive tape test. However, when the thus treated steel sheet and a steel sheet, which had been pickled according to the method of the present invention after the degreasing, were subjected to the decarburizing annealing, application of an annealing separator and final annealing at a high temperature under the same condition to form glass films on the surfaces of the steel sheets respectively, and the glass film formed on the surface of the former steel sheet was compared with the glass film formed on the surface of the latter steel sheet, it was found that the latter glass film is remarkably superior to the former glass film in uniformity and particularly in adhesion. Therefore, the reason why the effect of the present invention appears is presumably as follows. The surface of the steel sheet is always kept in a constant condition due to the removal of a very small amount of substances adhered to the surface before the continuous decarburizing annealing together with the surface layer portion of the steel base. In other words the surface condition of steel sheet before decarburizing annealing, which is difficult to be expressed quantitatively or to be controlled, has been easily kept to a constant condition. While, the mechanism, wherein the adhesion and uniformity of glass film is improved is not yet fully clarified, it may be that that a very small roughness of the steel sheet surface formed by the pickling contributes to the improvement of the adhesion.

The treating method of the present invention will be explained concretely hereinafter.

The silicon steels to be treated in the present invention are common silicon steel sheets containing 2 to 4% of Si, which have previously been hot rolled, successively annealed and cold rolled under proper conditions into a final gauge, and degreased. In this case, the composition of the silicon steel and the treating conditions until the final cold rolling are outside the scope of the present invention. For example, the silicon steel may contain any of elements S, Se, Sb, Al and the like as an inhibitor, and further any reduction rates may be adopted in the hot and cold rollings. The pickling of the present invention may be carried out in a separate pickling step, in a pickling unit combined to the latter part of a conventional degreasing line, or in a pickling unit combined to the fore part of a conventional decarburizing annealing line. In this case, since it is necessary to prevent the formation of rust after the pickling as far as possible, it is most desirable to combine a pickling unit to the fore part of a decarburizing annealing line. After the pickling, the after-treatment can be carried out in the same manner as the after-treatment in the pickling of common steel sheets, that is, the pickled steel is immediately washed with water and dried. The acids to be used in the pickling of the present invention are ones commonly used in the pickling of iron and steel, and are, for example, sulfuric acid, hydrochloric acid, nitric acid, hydrofluoric acid, phosphoric acid and the like. However, sulfuric acid and hydrochloric acid are advantageously used in view of the pickling ability, cost and easiness in the treatment of waste acid.

It is necessary to carry out the pickling to such an extent that the adhered substances to the steel surface are completely removed and the steel base is exposed throughout the steel surface. However, in order to obtain a reliable adhesion of glass film, it is effective to select a pickling condition so that the steel base surface is dissolved and removed within a certain range in both the cases wherein a large amount of substances are adhered to the steel surface, and wherein substantially no substance is adhered.

For a better understanding of the invention, reference is taken to the accompanying drawing, wherein the single FIGURE is a graph showing a relation between the amount of steel strip decreased in the pickling of the present invention and the adhesive strength of glass film.

A steel strip was pickled under various conditions as shown in the following Table 1, and the pickled steel strip was subjected to a decarburizing annealing, applied with magnesia, finally annealed at a high temperature to form a glass film.

Table 1

| Acid | Concentration (Wt.%) | Temperature (°C) | Time (sec) | Pickling decrease (g/m²) |
|---|---|---|---|---|
| $H_2SO_4$ | 5 | 70 | 20 | 1.9 |
| HCl | 20 | 40 | 30 | 3.4 |
| $H_2SO_4$ | 5 | 70 | 40 | 5.1 |
| HCl | 20 | 50 | 45 | 14.0 |
| $H_2SO_4$ | 20 | 75 | 60 | 38.0 |

The single FIGURE shows a relation between the amount of the steel strip decreased in the above described pickling (hereinafter, amount of steel sheet or strip decreased in pickling is referred to as "pickling decrease") and the adhesive strength of the resulting glass film. The adhesive strength is shearing adhesive strength, and was measured in the following manner. An epoxy resin adhesive was applied to one end of 1 cm² of two strip-shaped test pieces and the two test pieces were superposed and adhered. Then, the two test pieces were pulled in a horizontal direction, and the force required for peeling off the test pieces was measured. The test pieces were taken out from 10 portions in the width direction of the steel strip per 1 pickling condition.

As seen from the FIGURE, when the pickling decrease is not less than about 3 g per 1 m² of steel sheet (hereinafter abbreviated as 3 g/m²), the adhesive strength is improved, and roughness in the width direction of the steel strip is decreased. Further, when the pickling decrease is not less than about 10 g/m², a very high adhesive strength of about 200 Kg/m² is obtained.

From the above obtained result, in the present invention, the extent of pickling is represented by the pickling decrease of steel sheet and is limited to at least 3 g/m². In this case, the term "1 m²" means 1 m² of the steel sheet in both the sides and consequently the pickling decrease per one side is 1.5 g/m². While, when the pickling is effected under more severe condition, the thickness of the sheet is smaller, and even when the aimed range of sheet thickness is maintained, the space factor is decreased and the economical loss is larger. Accordingly, the upper limit is naturally limited in the commercial production. Therefore, although the upper limit of the pickling decrease is not particularly limited in the present invention, the upper limit is probably not more than 50 g/m² for the practical purpose.

Steps for continuous decarburizing annealing, application of annealing separator and final annealing at a high temperature following to the pickling can be carried out according to commonly known methods in the production of oriented silicon steel sheets at present. That is, a decarburizing annealing is carried out continuously under a $H_2$—$H_2O$ containing atmosphere to form silicon oxide and iron oxide. When the thickness of the oxide layer is small and is less than 3 $\mu$, the adhesion improves remarkably, and further even when the thickness is large and is about 5 $\mu$, the adhesion is improved. As the annealing separator, magnesia is used alone or in admixture with at least one of titanium oxide and manganese oxide, and in both cases, the uniformity and adhesion of the resulting glass film are improved. The final annealing is carried out by a box annealing at 1,100°–1,300°C under hydrogen bearing atmosphere.

The following examples are given for the purpose of illustration of this invention and are not intended as limitations thereof.

EXAMPLE 1

A cold rolled 3.3% silicon steel strip having a thickness of 0.30 mm, a width of 970 mm and a length of about 2,800 m was degreased and cleaned. Then, the steel strip was pickled for 60 seconds in a 20% sulfuric acid bath kept at about 75°C. The pickling decrease in the above treatment was measured by using a small test piece and was found to be about 40 g/m². Successively, the above pickled steel strip was subjected to a continuous decarburizing annealing at 820°C for 5 minutes under an atmosphere having a dew point of 60°C and consisting of 70% of hydrogen and the remainder of nitrogen, applied with an aqueous slurry of powdery MgO as an annealing separator, dried by heating, and then wound up in the form of a coil. The amount of MgO applied per side was 6.5 g/m² after drying.

The resulting coil was subjected to a final annealing at 1,200°C for 15 hours under hydrogen atmosphere in a box-type annealing furnace. After cooling, unreacted annealing separator was removed, and the uniformity of the appearance of the resulting glass film was estimated. The resulting steel strip was subjected to a flattening annealing to remove the coil set of the sheet, and then, in order to improve the electric insulating property of the steel strip, applied with a treating solution, which was prepared by dissolving 3 Kg of chromic anhydride and 7.5 Kg of aluminium nitrate in 1,000 cc of a 15% magnesium phosphate aqueous solution, and baked at 450°C for 1 minute to obtain a final product. Epstein test pieces of 30 mm width were sampled, and subjected to a stress relief annealing at 800°C for 5 hours under nitrogen atmosphere, after which the bending adhesion, adhesive strength and space factor of the test pieces were measured.

The obtained results are shown in the following Table 2 together with the results of the following Examples.

EXAMPLE 2

The same steel strip as used in Example 1 was degreased and cleaned. Then, the steel strip was pickled for 45 seconds in a 20% hydrochloric acid bath kept at about 50°C, and successively subjected to a continuous annealing at 820°C for 5 minutes under an atmosphere having a dew point of 60°C and composed of 70% of hydrogen and the remainder of nitrogen, applied with an aqueous slurry composed of 10% of $TiO_2$ and the remainder of MgO as an annealing separator, dried and wound up in the form of a coil.

In the above treatment, the pickling decrease was about 14 g/m² and the applied amount of the separator per side was 7.5 g/m². The resulting coil was treated under the same condition as described in Example 1.

EXAMPLE 3

The treatment of Example 1 was repeated, except that the pickling was effected for about 40 seconds in a 5% sulfuric acid bath kept at about 70°C. In this treatment, the pickling decrease was about 5 g/m².

COMPARATIVE EXAMPLE

The treatment of Example 1 was repeated, except that the pickling was not effected.

Table 2 shows the results obtained in the above Examples. As seen from Table 2, the present invention is very effective for the improvement of the uniformity and adhesion of glass film. Particularly, the fact that after the final coating and the stress relief annealing under nitrogen, the glass film has a high adhesive strength shows that steel strips having the glass film by the present invention are very useful as a core material of the wound core type transformer, which is subjected to impregnation adhering and to mechanical working after stress relief annealing.

Further, the space factor in the present invention is substantially the same as that in the conventional method (Comparative Example), and there is no problem in this point.

Table 2

| Example | Pickling decrease ($g/m^2$) | Appearance of glass film | After stress relief annealing in $N_2$ Bending adhesion (20 mmϕ) | | Adhesive strength ($Kg/cm^2$) | Space factor (%) |
|---|---|---|---|---|---|---|
| 1 | 40 | uniform grey coating is formed all over the surface | inner side: | substantially no change | 180 | 97.8 |
| | | | outer side: | no change | | |
| 2 | 14 | ditto | | ditto | 150 | 98.0 |
| | | | inner side: | changed to somewhat white | 110 | 97.9 |
| 3 | 5 | ditto | | | | |
| | | | outer side: | no change | | |
| | | | inner side: | dropped off all over the surface | | |
| Comparative Example | not pickled | grey and white uneven pattern | outer side: | somewhat dropped off | 50 | 97.9 |

We claim:

1. In a method for forming a highly adhesive uniform insulating glass film consisting mainly of forsterite on surfaces of an oriented silicon steel sheet, comprising sequential steps of:

a. cleaning surfaces of a cold rolled silicon steel strip said cleaning including a degreasing step and said steel strip having a final gauge and containing 2–4% of silicon;

b. subjecting the cleaned steel strip to a decarburizing annealing at a temperature of 700°–900°C under a wet hydrogen atmosphere to form $SiO_2$-containing oxide film on the surfaces of the steel strip; and c. applying to the decarburized steel strip an annealing separator consisting mainly of magnesia, winding the steel strip in the form of a coil, and subjecting the coiled steel strip to a final annealing at a temperature of 1100°–1300°C under a hydrogen-containing atmosphere, the improvement comprising pickling the cold rolled silicon steel strip following the degreasing part of the cleaning step and prior to the decarburizing annealing such that the surface layers of the steel strip are removed in an amount of at least $3 g/m^2$.

2. The method as claimed in claim 1, wherein the pickling agent is selected from the group consisting of sulfuric acid and hydrochloric acid.

3. The method as claimed in claim 1, wherein the pickling is effected so that the surface layers of the steel strip are removed in an amount of $3 g/m^2 - 50 g/m^2$.

4. The method as claimed in claim 1, wherein the pickling is effected so that the surface layers of the steel strip are removed in an amount of at least $10 g/m^2$.

* * * * *